United States Patent [19]

Masuda et al.

[11] Patent Number: 4,662,362

[45] Date of Patent: May 5, 1987

[54] MASSAGE APPARATUS

[75] Inventors: Teruo Masuda, Tokyo; Kichiro Yamaguchi, Kumagaya, both of Japan

[73] Assignee: France Bed Co., Ltd., Tokyo, Japan

[21] Appl. No.: 595,051

[22] Filed: Mar. 30, 1984

[30] Foreign Application Priority Data

| | | | |
|---|---|---|---|
| Apr. 11, 1983 | [JP] | Japan | 58-63339 |
| Sep. 17, 1983 | [JP] | Japan | 58-171545 |
| Oct. 5, 1983 | [JP] | Japan | 58-185132 |
| Oct. 24, 1983 | [JP] | Japan | 58-198914 |
| Dec. 19, 1983 | [JP] | Japan | 58-194013[U] |
| Dec. 20, 1983 | [JP] | Japan | 58-194867[U] |

[51] Int. Cl.[4] ..... A61H 15/00; A47C 27/05; E01B 26/00

[52] U.S. Cl. ..... 128/33; 5/465; 5/481; 128/52; 128/57; 238/10 R

[58] Field of Search ..... 128/33, 51, 52, 57, 128/58, 36, 70; 5/417, 481, 464, 465; 238/10 R

[56] References Cited

U.S. PATENT DOCUMENTS

| | | | |
|---|---|---|---|
| 2,675,179 | 4/1954 | Johnson | 238/10 R |
| 2,830,306 | 4/1958 | Wagner | 5/481 |
| 2,878,494 | 3/1959 | Healy | 5/481 |
| 3,604,148 | 9/1971 | Neuhierl | 238/10 R |
| 3,885,257 | 5/1975 | Rogers | 5/464 |
| 3,996,929 | 12/1976 | Mabuchi | 128/52 |
| 4,316,298 | 2/1982 | Russo | 5/481 |
| 4,336,621 | 6/1982 | Schwartz | 5/464 |
| 4,370,767 | 2/1983 | Fraser | 5/417 |
| 4,373,516 | 2/1983 | Masuda et al. | 128/57 |
| 4,412,534 | 11/1983 | Hamabe | 128/57 |
| 4,458,675 | 7/1984 | Nakao | 128/52 |

FOREIGN PATENT DOCUMENTS

| | | | |
|---|---|---|---|
| 1090227 | 11/1978 | Canada | 128/36 |
| 58858 | 1/1982 | European Pat. Off. . | |
| 1499275 | 9/1967 | France | 128/70 |
| 2472933 | 7/1981 | France . | |
| 6602793 | 9/1966 | Netherlands | 5/465 |
| 407129 | 3/1934 | United Kingdom | 238/10 R |
| 542521 | 1/1942 | United Kingdom | 238/10 |
| 1559851 | 1/1980 | United Kingdom | 5/481 |

*Primary Examiner*—Clyde I. Coughenour

*Attorney, Agent, or Firm*—Frishauf, Holtz, Goodman & Woodward

[57] ABSTRACT

A massage apparatus is provided with a pair of foldable guide rails extending parallel to each other. Carriers having massage rollers thereon are set on the guide rails so as to be able to reciprocate along the guide rails. The carriers are coupled to belts which travel along the guide rails in a reciprocating manner.

21 Claims, 50 Drawing Figures

MASSAGE APPARATUS

BACKGROUND OF THE INVENTION

The present invention relates to a massage apparatus for massaging the body of a user, and more specifically to a mattress-type massage apparatus for massaging the entire body of a user lying thereon.

An example of this mattress-type massage apparatus is disclosed in U.S. Pat. No. 4,373,516. In this conventional massage apparatus, an enclosure in the form of a mattress contains therein a rigid base plate, a pair of rigid guide rails arranged parallel to each other on the base plate, and a massage roller capable of reciprocating along the guide rails. In using such an apparatus, therefore, a user can have a massage by lying on the enclosure while the massage roller reciprocates along the guide rails.

However, the user will not be able to have his whole body massaged by the massage apparatus with this construction while lying thereon unless the guide rails and the base plate are longer than the stature of the user. Thus, the enclosure needs to be at least two meters long, making the massage apparatus fair-sized. When not in use, therefore, the massage apparatus is very obstructive as it requires a large space for storage. Owing to its elongate structure, moreover, the massage apparatus is too bulky to carry about.

SUMMARY OF THE INVENTION

The primary object of the present invention is to provide a mattress-type massage apparatus the whole body of which can be folded at least in two.

According to the invention, there is provided a massage apparatus which comprises: at least two guide rails extending parallel to each other, each of the guide rails being able to be folded in two or more; at least one carrier disposed on the guide rails so as to be able to travel along the guide rails, the carrier having at least one massage roller; driving means for reciprocating the carrier along the guide rails, the driving means including at least one elongate member for power transmission coupled to the carrier and capable of traveling along the guide rails between one and the other end sides thereof, and a driving section disposed at one end side of the guide rails for reciprocating the elongate member.

According to the massage apparatus of the invention, the guide rails are foldable, so that the whole apparatus can be, for example, folded in two. When not in use, therefore, the massage apparatus can be folded for the ease of carrying or for storage.

The above and other objects and advantages of the invention will be apparent in the following detailed description of illustrative embodiments thereof which is to be read in connection with the accompanying drawings.

DETAILED DESCRIPTION OF THE PREFERRED EMBODIMENTS

Figure 1:
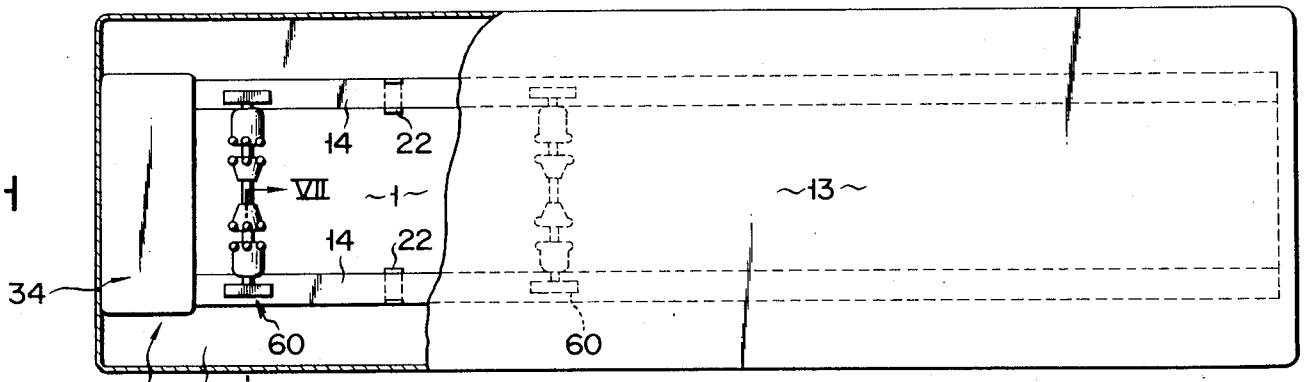
FIG. 1 is a broken-away plan view of a mattress-type massage apparatus according to one embodiment of the present invention.
Figure 2:
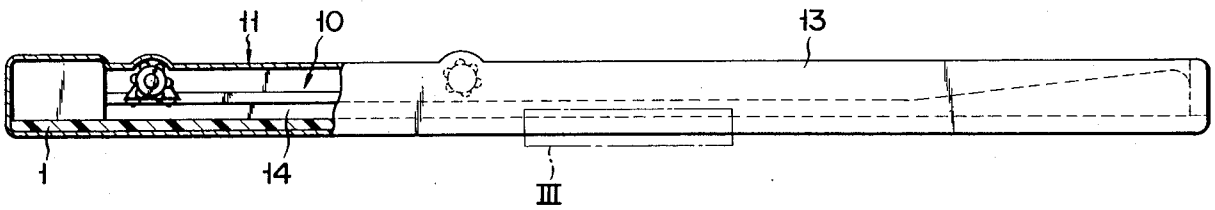
FIG. 2 is a broken-away side view of the massage apparatus shown in FIG. 2.
Figure 3:
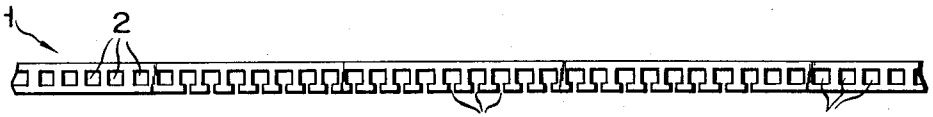
FIG. 3 is a side view of a base plate at section III of FIG. 2.

Referring now to FIGS. 1 and 2, there is schematically shown a mattress-type massage apparatus according to one embodiment of the present invention. The massage apparatus is provided with a rectangular base plate 1. The base plate 1 is integrally formed from nylon, polypropylene, polyvinyl chloride, urethane or some other synthetic resin, having the configuration mentioned below and a measure of flexibility. As shown in FIG. 3, a number of cavities 2 having a rectangular cross-section are arranged parallel to the direction along the width of the base plate 1. The cavitives 2 penetrate the base plate 1 across the same. Namely, the cavities 2 extend from one side face of the base plate 1 to the other. Also, the cavities 2 are arranged at regular intervals in the longitudinal direction of the base plate 1. As seen from FIG. 3, those cavities 2, which are located in the central portion of the base plate 1 indicated by symbol III of FIG. 2, open individually to the undersurface of the base plate 1 by means of slits 3 therein. Like the cavities 2, the slits 3 extend across the base plate 1. With such an arrangement, the base plate 1 can be folded in two at its predetermined folding portion or section III of FIG. 2, since the folding portion is expressly flexible. In FIG. 2, the base plate 1 is shown only schematically, and the cavitives 2 and the slits 3 are omitted.

Figure 4:
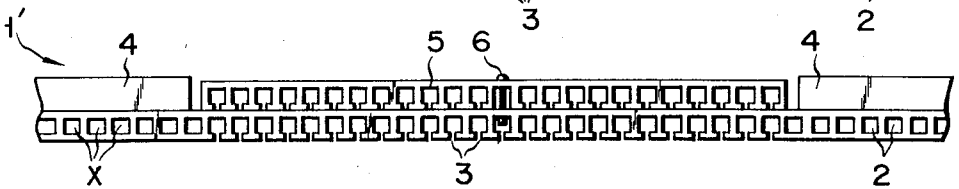
FIG. 4 shows a modification of the base plate shown in FIG. 3.

The base plate 1 is not limited to the configuration shown in FIG. 3, and may be replaced with a base plate 1' constructed as shown in FIG. 4. The base plate 1' is formed by combining the base plate 1 shown in FIG. 3 with two flexible or rigid reinforcement plates 4 formed of synthetic resin or laminated plywood and a flexible plate 5. The reinforcement plates 4, are bonded, or coupled by means of screws not shown, to the whole upper surface of the base plate 1 except for section III of FIG. 2. The flexible plate 5 has the same configuration as the section III of the base plate 1, and is coupled to the upper surface of the section III by means of coupling screws 6. The coupling screws 6 are arranged only in the central portion of the flexible plate 5. Like the base plate 1, the base plate 1' with such an arrangement can be folded at its predetermined folding portion.

The base plate 1 is mounted with a massage device 10 which will be mentioned later. The base plate 1 and the massage device 10 are covered with a covering 11. The covering 11 is formed of a cushion portion 12 surrounding the massage device 10 and a wrapping cloth 13. The cushion portion 12 is a flexible portion made of an elastic material, such as urethane foam. The wrapping cloth 13 is in the form of an enclosure made of canvas, nylon cloth or other cloth with a relatively high wear resistance.

Referring now to FIGS. 5 to 12, the massage device 10 inside the covering 11 will be described in detail. The massage device 10 is provided with a pair of guide rails 14. The guide rails 14 are arranged at a predetermined space on the base plate 1, extending parallel to each other along the longitudinal direction of the base plate 1. Like the baseplate 1, the guide rails 14 are integrally formed froma synthetic resin and are somewhat flexible. As shown in detail in FIG. 7, the cross section of each guide rail 14 includes an intermediate strip portion 15, upper and lower L-shaped retaining portions 16 which face each other and which protrude upward and downward from one side edge of the intermediate strip portion 15 and extend along the longitudinal direction of the base plate 1, an I-shaped protrusion 17 vertically extending from the other side edge of the intermediate strip portion 15, and two pair of angled projections 18 protruding from the upper and lower surfaces of the central portion of the intermediate strip portion 15 so as to cover part of the same. Thus, an upper passage 19 surrounded by the intermediate strip portion 15 and the upper parts of the projections 18, and a lower passage 20 surrounded by the intermediate strip portion 15 and the lower parts of the projections 18 are defined at the central portion of the width of each guide rail 14. The upper and lower passages 19 and 20 serve as guide passages for traveling belts which will be mentioned later. The region between one upper projection 18 and the upper retaining portion 16 above the intermediate strip portion 15 forms a rail groove for the wheels of a carrier which will be mentioned later.

Figure 5:
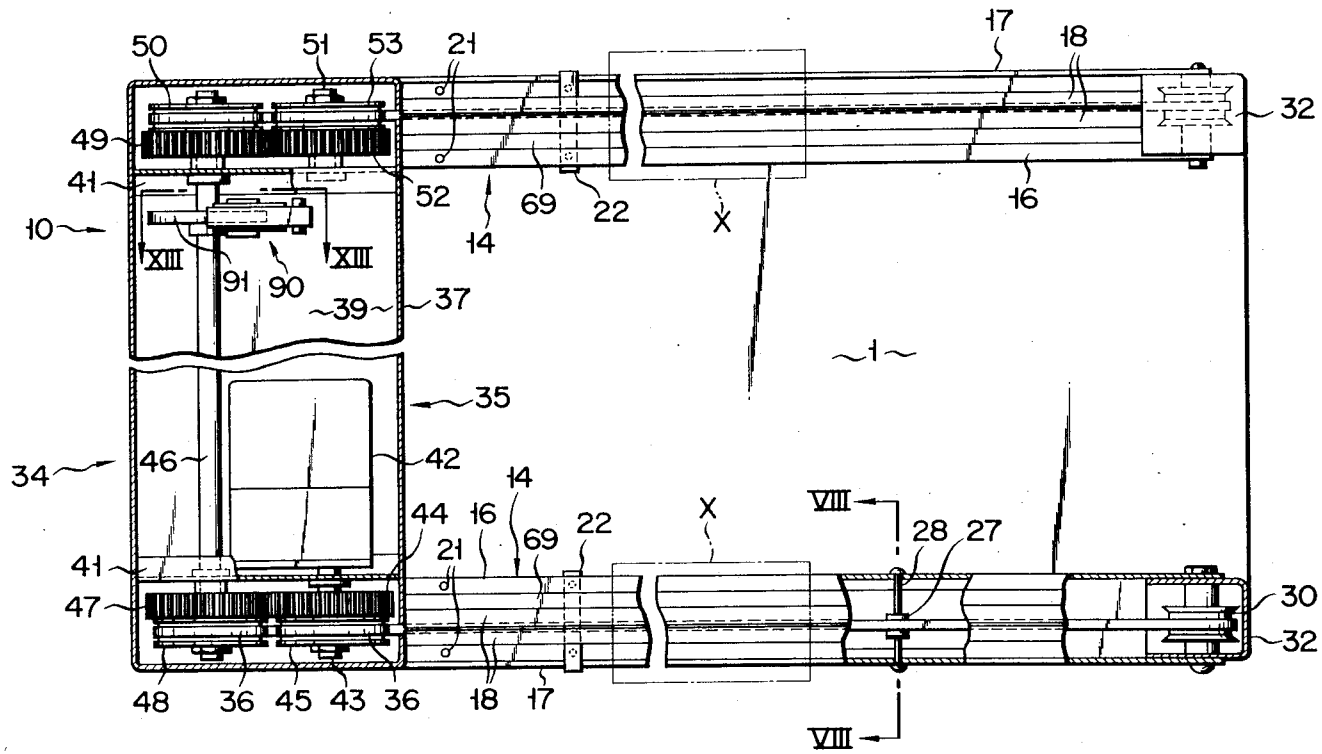
FIG. 5 is a broken-away plan view showing guide rails and a driving mechanism used in the massage apparatus of FIG. 1.
Figure 7:
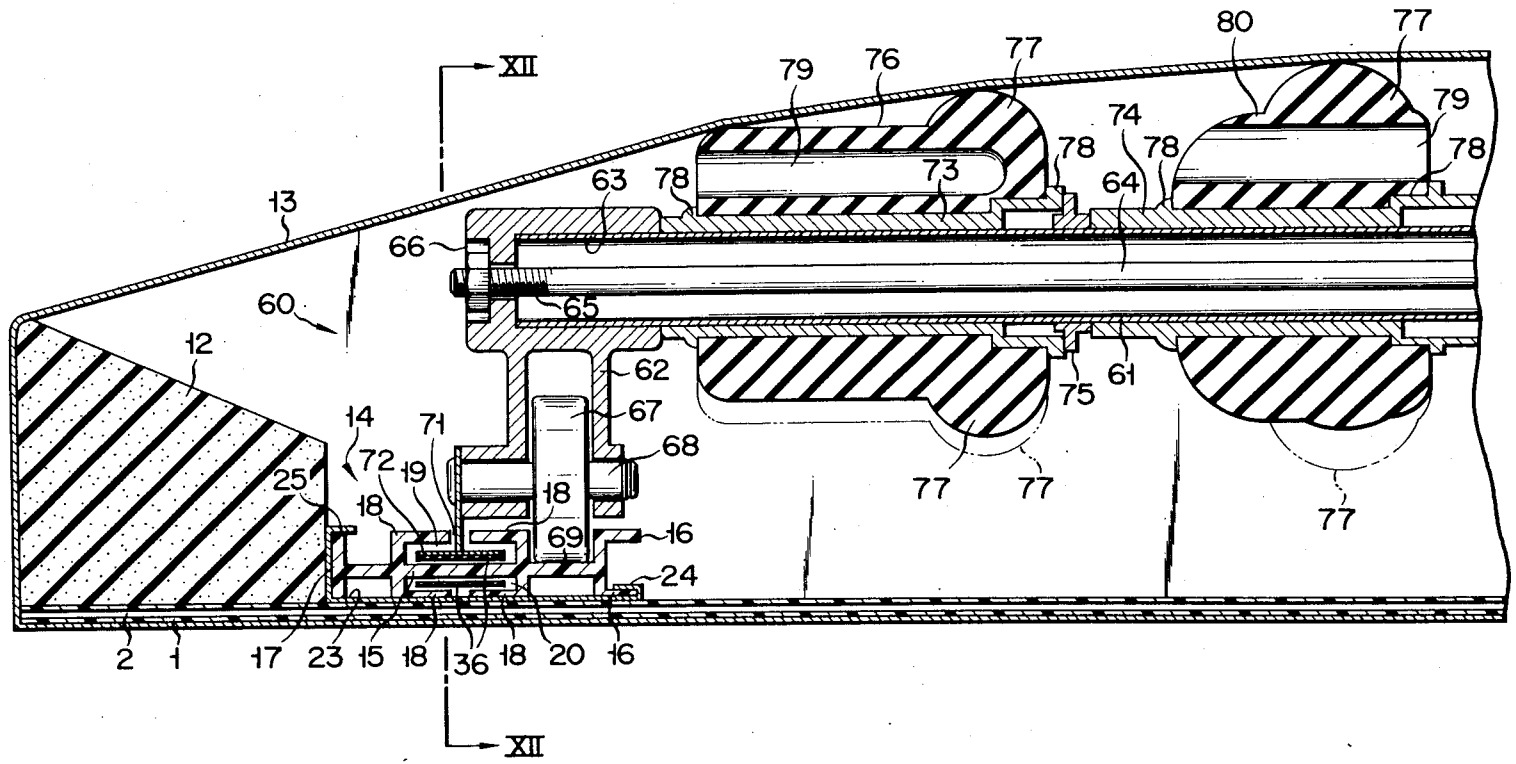
FIG. 7 is a sectional view taken along line VII—VII of FIG. 1.

As shown in FIG. 5, only one end portion of each guide rail 14 is fixed to the base plate and a unit case which will be mentioned later by means of a plurality of fixing screws 21. The other end side of each guide rail 14 is slidably supported by a plurality of support members 22 as shown in FIGS. 1, 5 and 7. In FIGS. 1 and 5, only one support member 22 is illustrated for each guide rail 14. As shown in detail in FIG. 7, each support member 22 includes an intermediate strip portion 23 located between the lower surface of the guide rail 14 and the upper surface of the base plate 1 and fixed to the base plate 1 by means of setscrews (not shown), a first holding portion 24 on one side edge of the intermediate strip portion 23 for slidably holding the lower retaining portion 16 of the guide rail 14, and a second holding portion 25 on the other side edge of the intermediate strip portion 23 for slidably holding the protrusion 17 of the guide rail 14.

Figure 6:
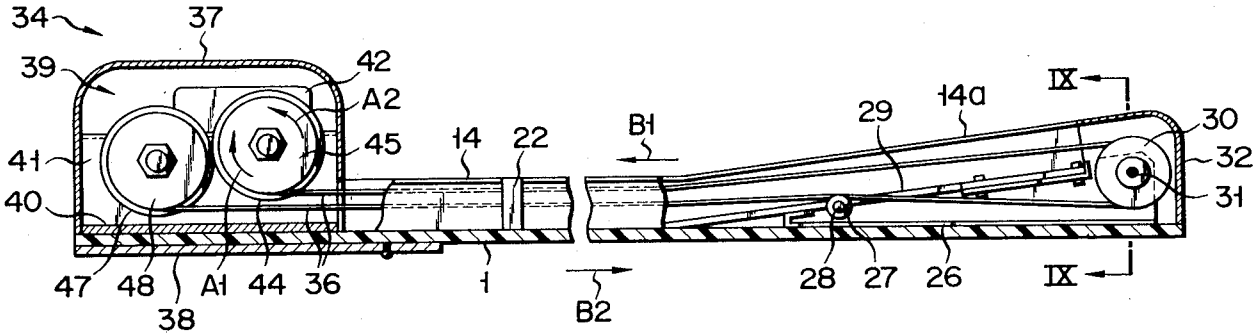
FIG. 6 is a broken-away schematic side view showing the guide rail and the driving mechanism of FIG. 5.
Figure 9:
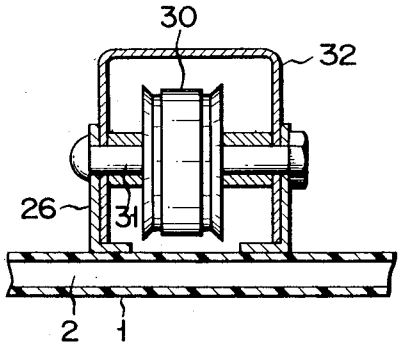
FIG. 9 is a sectional view taken along line IX—IX of FIG. 6.
Figure 8:
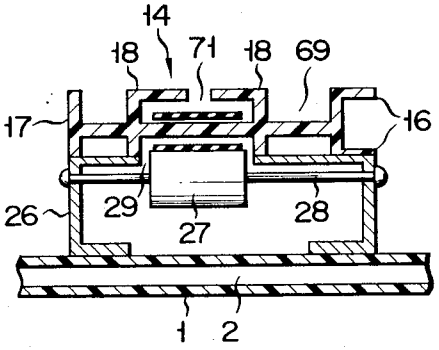
FIG. 8 is a sectional view taken along line VIII—VIII of FIG. 5.

As shown in FIG. 6, the other end side portion of each guide rail 14 is bent upward or away from the upper surface of the base plate 1. This bent portion **14*a* of the guide rail 14 is held on a slope frame 26. As shown in FIG. 8, a pitching roll 27 is rotatably supported inside the slope frame 26 at one end portion thereof by means of a support shaft 28. The pitching roll 27 projects slightly from the upper surface of the slope frame 26 through an opening 29 in the top wall of the slope frame 26. As shown in FIG. 8, moreover, those lower parts of the projections 18 of the guide rail 14 which correspond to the opening 29 of the slope frame 26 are partially cut away. As shown in FIG. 9, a pulley 30 is rotatably supported inside the other end side portion of the slope frame 26 projected from the guide rail 14 by means of a support shaft 31. The other end portion of the slope frame 26 is closed by a cap 32**.

Figure 10:
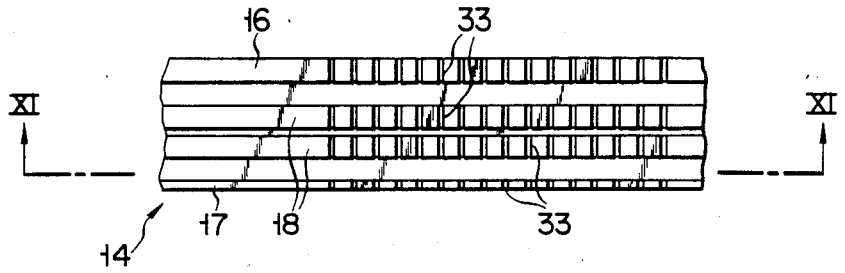
FIG. 10 is a partial plan view of the guide rail at section X of FIG. 5.
Figure 11:
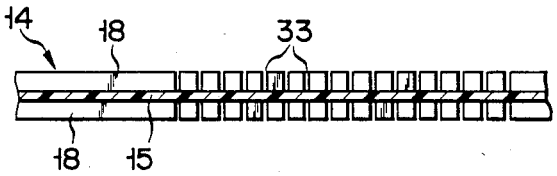
FIG. 11 is a sectional view taken along line XI—XI of FIG. 10.

As shown in FIGS. 10 and 11, a number of slits 33 are formed in that region of each guide rail 14 which corresponds to the predetermined folding portion of the base plate 1 indicated by symbol III in FIG. 2, that is, portion X of FIG. 5. These slits 33 are arranged across the width of the guide rails 14 except for the intermediate strip portion 15 thereof. Therefore, the region indicated by symbol X in FIG. 5. like the predetermined folding portion of the base plate 1, is expressly flexible, and the guide rails 14 can be folded in two at the predetermined fold portion or at region X.

A drive mechanism 34 is mounted on the base plate 1. The drive mechanism 34 comprises a drive unit 35 set on the one end portion of the base plate 1 so as to adjoin the one end of each guide rail 14, and a pair of traveling belts 36 driven by the drive unit 35. The drive unit 35 is provided with a unit case 37. The unit case 37 stretches between the two guide rails 14. As shown in FIG. 6, a rigid reinforcement plate 38 is attached as required to the lower surface of that portion of the base plate 1 on which the drive unit 35 is mounted. As shown in FIG. 5, a mounting board 39 is housed in the unit case 37. The mounting board 39 consists of a level plate portion 40 on the top of the base plate 1, and standing plate portions 41 on both end edges of the level plate portion 40 near the guide rails 14. Disposed between the two standing plate portions 41 of the mounting board 39 is a unit motor 42 which is a combination of an electric motor and a reducer. The unit motor 42 is a reversible motor whose output shaft 43 extends to the outside through one of the standing plate portions 41 of the mounting board 39. A first driving gear 44 formed of a spur gear and a first driving pulley 45 are successively mounted on the output shaft 43 of the unit motor 42, located outside the mounting board 39. Between the standing plate portions 41 of the mounting board 39, a first driven shaft 46 extends parallel to the output shaft 43 of the unit motor 42. Both end portions of the first driven shaft 46 extend through the standing plate portions 41 of the mounting board 39 to the outside thereof. Thus, the first driven shaft 46 is rotatably supported between the two standing plate portions 41. One end portion of the first driven shaft 46 near the unit motor 42 is successively fitted with a first driven gear 47 in mesh with the first driving gear 44 and a first driven pulley 48 paired with the first driving pulley 45. A second driving gear 49 formed of a spur gear and a second driving pulley 50 are successively mounted on the other end portion of the first driven shaft 46, located outside the other standing plate portion 41. A second driven shaft 51 parallel to the first driven shaft 46 is rotatably supported on that standing plate portion 41 of the mounting board 39 which rotatably supports the other end portion of the first driven shaft 46. The second driven shaft 51 extends to the outside of the standing plate portion 41. The second driven shaft 51 is fitted with a second driven gear 52 to mesh with the second driving gear 49, and a second driven pulley 53 which is paired with the second driving pulley 50. The gears 44, 47, 49 and 52 are all rotated at the same speed.

One of the paired traveling belts 36 formed of, e.g., steel, stainless steel on cloth belts for transmitting power is wound around the first driving pulley 45. One end of this traveling belt 36 is fixed to the first driving pulley 45. As shown in FIG. 6, one traveling belt 36 is guided from the first driving pulley 45 into the upper passage 19 of the one guide rail 14, travels along the upper passage 19, and is passed around the pulley 30 to change its course about 180°. Then, the traveling belt 36 is passed through the interior of the slope frame 26 and the opening 29 thereof, turns to a somewhat different direction on the pitching roll 27, and is led to the first driven pulley 48 through the lower passage 20 of the guide rail 14. Also at the first driven pulley 48, the traveling belt 38 is wound around the first driven pulley 48 with its other end fixed thereto. In FIG. 6, the guide rail 14 is illustrated as a mere hollow passage for simplicity. FIG. 7 shows how the traveling belt 36 is actually guided through the upper and lower passages 19 and 20 of the guide rail 14.

The other traveling belt 36 is guided through the other guide rail 14, and passed around the second driving pulley 50 and the second driven pulley 53.

According to the drive mechanism 34 with this construction, when the output shaft 43 of the unit motor 42 is rotated, for example, in the direction of arrow A1 in FIG. 6, the first driving pulley 45 rotates to be wound with the traveling belt 36. Since the first driven pulley 48 is rotated in the opposite direction to the first driving pulley 45, the traveling belt 36 is let out from the first driven pulley 48 in proportion to the length of the portion of the belt 36 wound on the first driving pulley 45. In this case, therefore, the portion of the traveling belt 36 guided through the upper passage 19 of the one guide rail 14 is run in the direction of arrow B1 in FIG. 6. In this case, moreover, the second driving pulley 50 is rotated in the same direction as the first driven pulley 48, and the second driven pulley 53 is rotated in the same direction as the first driving pulley 45. Accordingly, the traveling belt 36 guided through the upper passage 19 of the other guide rail 14 is run also in the direction of arrow B1 in synchronism with the traveling belt 36 runnding through the one guide rail 14.

Figure 12:
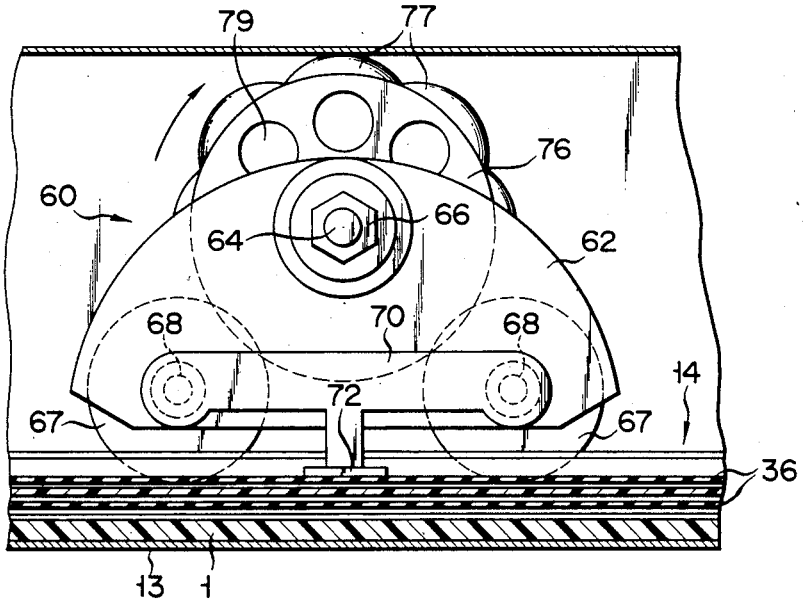
FIG. 12 is a sectional view taken along line XII—XII of FIG. 7.

As shown in FIGS. 1 and 2, two carriers 60 are arranged between the pair of guide rails 14 at a predetermined space in the longitudinal direction of the guide rails 14. Since these carriers 60 have the same construction, only one of them will be described in detail. As shown in FIG. 7, the carrier 60 is provided with a hollow shaft 61 which extends at right angles to the guide rails 14. Each end portion of the hollow shaft 61 is removably fitted in a fitting hole 63 formed in a support leg 62 on each side. FIG. 7 shows only one side of the structure. A support shaft 64 is coaxially passed through the hollow shaft 61. Both end portions of the support shaft 64 are formed into screw portions 65. Thus, the support shaft 64 is fixed to the support leg 62 by screwing a nut 66 on each screw portion 65. As shown in FIGS. 7 and 12, a pair of wheels 67 are rotatably attached to the support leg 62 by means of support shafts 68. The wheels 67 are fitted in the rail groove 69 of each guide rail 14 so as to be able to travel along the groove 69. As shown in FIG. 12, a substantially T-shaped coupler 70 is attached to the lower portion of the support leg 62. As shown in FIG. 7, both ends of that portion of the coupler 70 which extend along the guide rail 14 are attached individually to the support shafts 68 of the wheels 67. That portion of the coupler 70 which extends downward or toward the guide rail 14 penetrates the upper passage 19 of the guide rail 14 through a slit 71 defined between the upper parts of the projections 18, and is coupled to the traveling belt 36 by means of a coupling plate 72.

Since the traveling belts 36 are thus coupled to the support legs 62 or the carrier 60, the carrier 60 is caused to travel along the rail grooves 69 of the guide rails 14 as the traveling belts 36 run.

A pair of first sleeves 73 and a pair of second sleeves 74 are alternately mounted on the outer peripheral surface of the hollow shaft 61 of the carrier 60. The first and second sleeves 73 and 74 can rotate around the hollow shaft 61, and are restrained from axial movement by spacers 75, as shown in FIG. 7. Each first sleeve 73 is fitted with a cylindrical first massage roller 76. The massage roller 76 is integrally formed from a relatively hard elastic material, such as rubber or synthetic resin. A number of substantially hemispherical massage bumps 77 are circumferentially arranged at regular intervals on the outer peripheral surface of the first massage roller 76. The first massage roller 76 is restrained from axial dislocation by stoppers 78 on the first sleeve 73. A plurality of axially extending hollow portions 79 is formed in the first massage roller 76 corresponding to the massage bumps 77. Thus, the massage bumps 77 of the first massage roller 76 can easily be elastically displaced in the radial direction. Each second sleeve 74 is also fitted with a second massage roller 80 similar to the first massage roller 76. The second massage roller 80 differs from the first massage roller 76 in that its axial length is shorter than that of the first massage roller 76, and that it is penetrated by its hollow portions 79. It is to be understood that the second sleeve 74 is also provided with stoppers 78 similar to those for the first sleeve 73.

Thus, as the pair of traveling belts 36 travel, the first and second massage rollers 76 and 80 of each carrier 60 are moved along the pair of guide rails 14.

In order to effectively massage the entire body of a user, however, the first and second massage rollers 76 and 80 must be automatically reciprocated along the guide rails 14 within a predetermined range.

Figure 13:
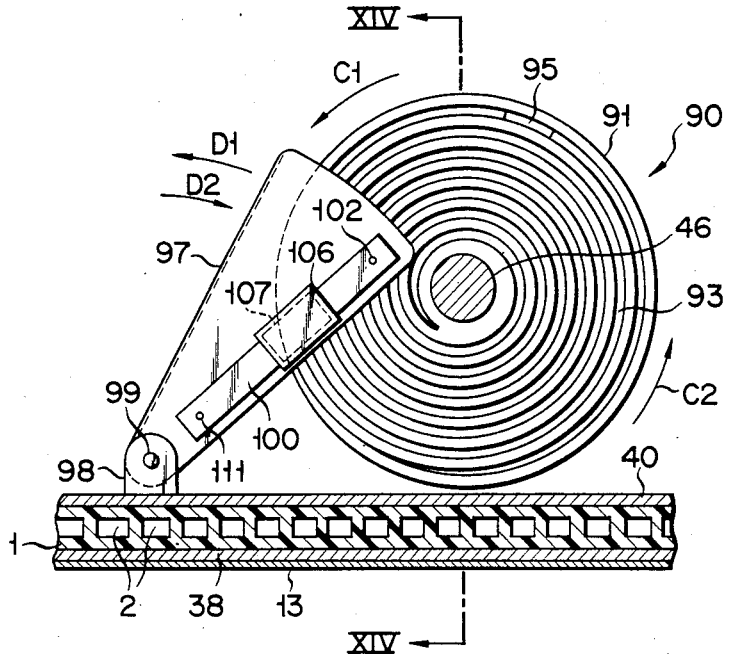
FIG. 13 is a sectional view taken along line XIII—XIII of FIG. 5.
Figure 14:
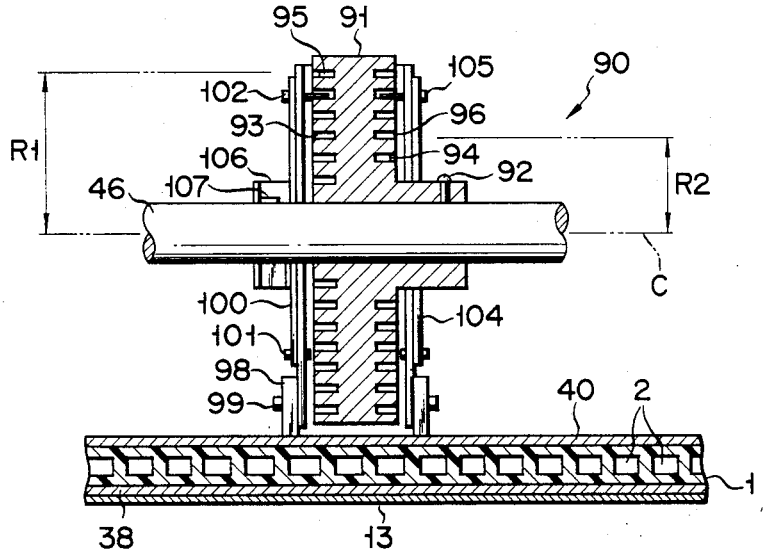
FIG. 14 is a sectional view taken along line XIV—XIV of FIG. 13.

Therefore, the apparatus according to the first embodiment of the invention is provided with a control unit 90 for automatically reciprocating the traveling belts 36. The control unit 90 is housed in the unit case 37 of the drive mechanism 34, as shown in FIG. 5, and is illustrated in detail in FIGS. 13 and 14. The control unit 90 is provided with a rotating disk 91. The rotating disk 91 is fixed to the first driven shaft 46 of the drive mechanism 34 by means of a setscrew 92. First and second spiral guide grooves 93 and 94 of the same configuration are formed on one and the other side faces of the rotating disk 91, respectively. A first step portion 95 and a second step portion 96 shallower than the remaining groove portions are formed in the first and second guide grooves 93 and 94, respectively. As shown in FIG. 14, the first step portion 95 is located at a radial distance R1 from the center of the rotating disk 91, while the second step portion 96 is at a radial distance R2 from the center. In this case, as seen from FIG. 14, the radius R1 is greater than the radius R2. This indicates that the first step portion 95 is located father away than the second step portion 96 for several turns of the first guide groove 93.

A rocking arm 97 is disposed beside the rotating disk 91. As shown in FIG. 13, the rocking arm 97 has a U-shaped cross-sectional shape so as to cover part of the rotating disk 91. The lower end portion of the rocking arm 97 is rockably supported on a pair of brackets 98 by means of support shafts 99. The brackets 98 are fixedly set on the level plate portion 40 of the mounting board 39. As shown in FIG. 13, a belt-shaped first left spring 100 is attached to one outer side face of the rocking arm 97. The first leaf spring 100 extends from the proximal end side of the rocking arm 97 toward its distal end side. The lower end portion of the first leaf spring 100 is fixed to the rocking arm 97 by means of a retaining shaft 101. A first pin 102 is attached to the upper end portion of the first leaf spring 100. The first pin 102 extends to the inside of the rocking arm 97 through one of openings 103 (see FIG. 16) in both the outer side faces of the rocking arm 97, and projects into the first guide groove 93 of the rotating disk 91. Like the first leaf spring 100, a second leaf spring 104 is attached to the other outer side face of the rocking arm 97. Like the first pin 102, a second pin 105 of the second leaf spring 104 projects into the second guide groove 94 of the rotating disk 97.

Figure 16:
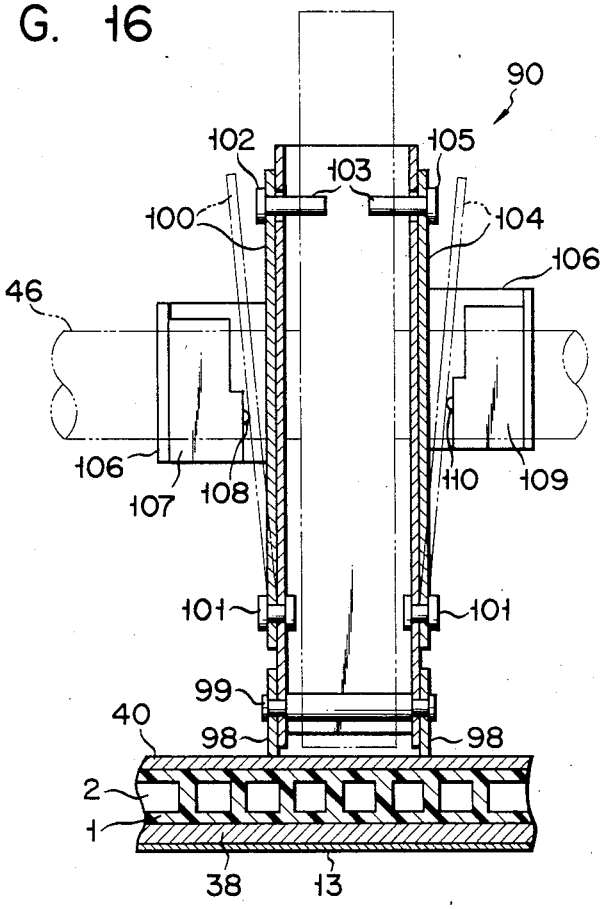

As shown in detail in FIG. 16, fixtures 106 formed of plate members are fixed to one outer sides face of the rocking arm 97, respectively. A first limit switch 107 formed of a microswitch is attached to one fixture 106. A push button 108 of the first limit switch 107 faces the first leaf spring 100 at a given gap. Likewise, a second limit switch 109 is attached to another fixture 106, and a push button 110 of the second limit switch 109 faces the second leaf spring 104 at a given gap. The first and second limit switches 107 and 109, and the electric motor section of the unit motor 42 are electrically connected to an electric circuit (not shown). This electric circuit is designed so as to reverse the rotating direction of the electric motor section of the unit motor 42 when one of the limit switches 107 and 109 is activated. The electric circuit includes a remote switch (not shown) for remotely controlling the drive of the electric motor section of the unit motor 42.

Figure 15:
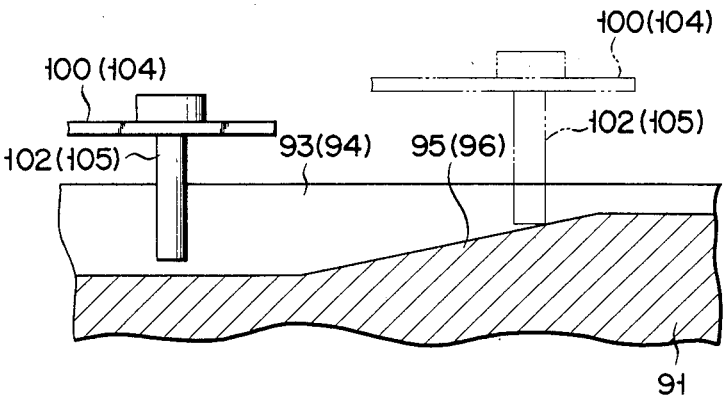
FIGS. 15 and 16 are diagrams for illustrating the operation of a control unit.

The operation of the control unit 90 with this construction will now be described. First, when the output shaft 43 of the unit motor 42 is rotated in the direction of arrow A1 (FIG. 6) by operating the remote switch, the pair of traveling belts 36 travels through the interior of their corresponding guide rails 14 in the manner described before. In this case, the traveling direction of the traveling belts 36 passing through the upper passages 19 of the guide rails 14 is the direction indicated by arrow B1 in FIG. 6. As the traveling belts 36 travel in this manner, the rotating disk 91 of the control unit 90 rotates with the first driven shaft 46. In this case, the rotating disk 91 rotates in the direction indicated by arrow C1 in FIG. 13, and the first and second pins 102 and 105 of the first and second leaf springs 100 and 104 on the rocking arm 97 are guided by the relative movement of the first and second guide grooves 93 and 94 of the rotating disk 91. As a result, the rocking arm 97 is rocked in the direction indicated by arrow D1 in FIG. 13. At this time, if both the first and second pins 102 and 105 of the first and second leaf springs 100 and 104 are located between the first and second step portions 95 and 96 of the first and second guide grooves 93 and 94 with respect to the radial direction of the rotating disk 91, the first pin 102 of the first leaf spring 100 will first run onto the first step portion 95 of the first guide groove 93, as indicated by the imaginary line in FIG. 15, as the rocking arm 97 rocks in the direction of arrow D1 in FIG. 13. Thus, the first leaf spring 100 of the rocking arm 97 bends backward, as indicated by the imaginary line in FIG. 16, to press the push button 108 of the first limit switch 107, thereby shifting the switch 107. At this point of time, the rotation of the output shaft 43 of the unit motor 42 is reversed from the direction of arrow A1 to the direction of arrow A2 by the aforementioned electric circuit, so that the traveling belts 36, having so far been running in the direction of arrow B1 through the upper passages 19 of the guide rails 14, start to run in the direction of arrow B2 opposite to the direction of arrow B1. As the rotating direction of the output shaft 43 of the unit motor 42 is switched from the direction of arrow A1 to the direction of arrow A2, the rotating direction of the rotating disk 91 is changed from the direction of arrow C1 to the direction of arrow C2. Also, the rocking direction of the rocking arm 97 is changed from the direction of arrow D1 to the direction of arrow D2. Accordingly, if the rotating disk 91 continues to rotate in the direction of arrow C2 in this state, then the second pin 105 of the second leaf spring 104 runs onto the second step portion 96 of the second guide groove 94 of the rotating disk 91. Thus, the second leaf spring 104 of the rocking arm 97 bends backward, as indicated by the imaginary line in FIG. 16, to press the push button 110 of the second limit switch 109, thereby shifting the switch 109. At this point of time, the rotation of the output shaft 43 of the unit motor 42 is reversed again from the direction of arrow A2 to the direction of arrow A1, so that the traveling belts 36 running through the upper passages 19 of the guide rails 14 change their courses again from the direction of arrow B2 to the direction of arrow B1. Thereafter, as the aforementioned sequence of operation is repeated, the traveling belts 36 running through the upper passages 19 of the guide rails 14 automatically change their courses from the direction of arrow B1 to the direction of arrow B2 or from B2 to B1. Accordingly, the carriers 60 coupled to the traveling belts 36 and hence the first and second massage rollers 76 and 80 are reciprocated along the guide rails 14. Here it is to be noted that the reciprocation stroke of the carriers 60 or the massage rollers 76 and 80 depends on the radial distance of the rotating disk 91 between the first step portion 95 of the first guide groove 94 and the second step portion 96 of the second guide groove 94.

In this case, through the above-mentioned control unit 90 serves to determine the maximum reciprocation stroke of the carriers 60, part within the maximum reciprocation stroke of the carriers 60 may be restricted by the electric circuit.

Figure 19:
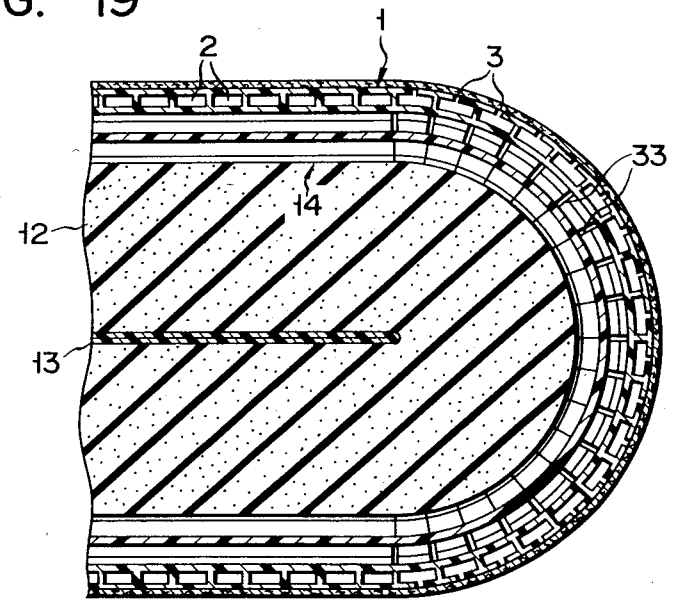
FIG. 19 is an enlarged sectional view of section XIX of FIG. 18.
Figure 17:
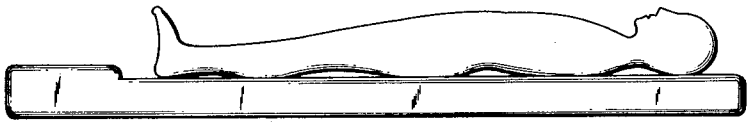
FIG. 17 is a schematic view showing how the massage apparatus is used.
Figure 18:
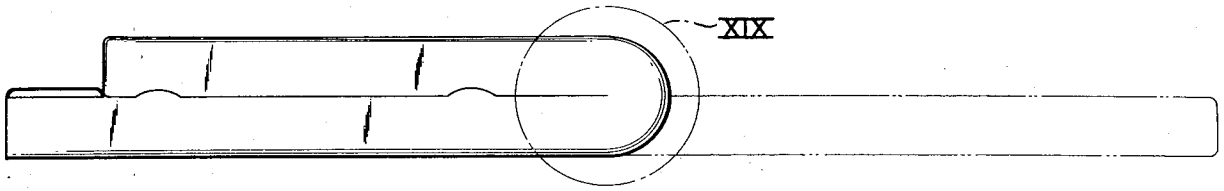
FIG. 18 shows the way the massage apparatus is folded in two.

Referring now to FIGS. 17 to 19, there will be described the way the user uses the massage apparatus according to the above-mentioned embodiment. As shown in FIG. 17, the user lies on the massage apparatus. In this state, if the user operates the remote switch (not shown) to actuate the unit motor 42, the massage rollers 76 and 80 will reciprocate along the guide rails 14 while rotating in contact with the inside of the wrapping cloth 13. Thus, the back of the user is massaged by the massage bumps 77 of the massage rollers 76 and 80.

When not in use, the massage apparatus with this construction can be folded in two as shown in FIG. 18, since the central portions of the base plate 1 and the guide rails 14 are expressly flexible. FIG. 19 shows a cross-sectional view of a fold portion of the massage apparatus. When storing the massage apparatus, therefore, its length can be halved, so that the storage space for the apparatus can be reduced. Moreover, the massage apparatus is handy to carry.

In this first embodiment, furthermore, only one end portion of each guide rail 14 is fixed to the base plate 1 by means of the fixing screws 21, while the other end side of each guide rail 14 is slidably held over the base plate 1 by means of the support members 22. Accordingly, the guide rails 14 or the whole massage apparatus can be easily be folded without producing any substantial bending stress in the guide rails 14.

It is to be understood that the present invention is not limited to the one embodiment described above, and that various changes and modifications may be effected therein by one skilled in the art without departing from the scope or spirit of the invention. Some of the modifications will be described below.

In the above embodiment, the traveling belts 36 are used as elongated members for power transmission. However, the belts 36 may be replaced with chains or wires.

Figure 20:
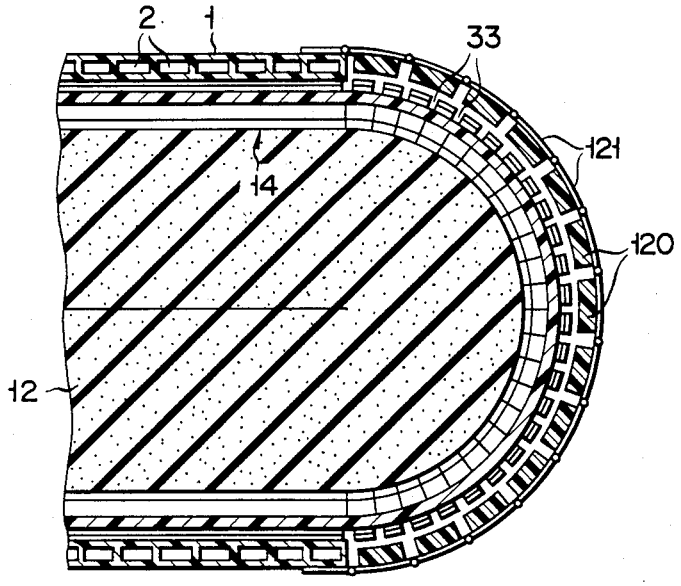
FIGS. 20 to 29 are sectional views showing several modifications of the folding portion of the massage apparatus.
Figure 21:
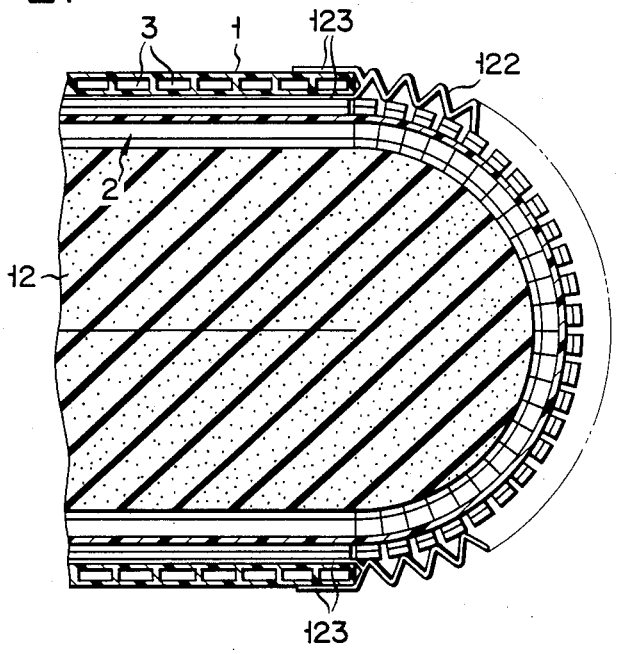
Figure 22:
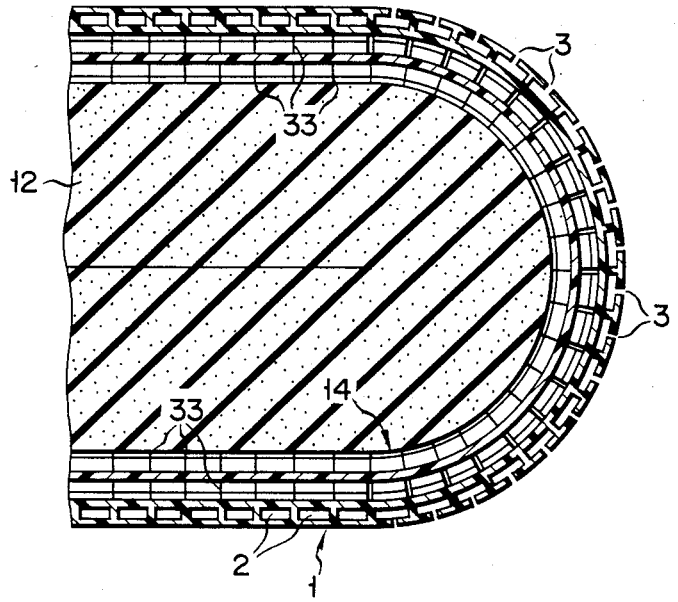
Figure 23:
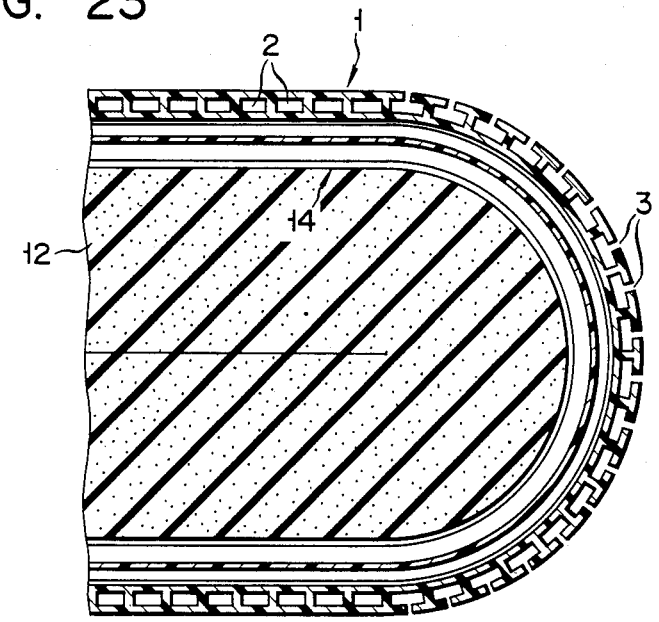
Figure 24:
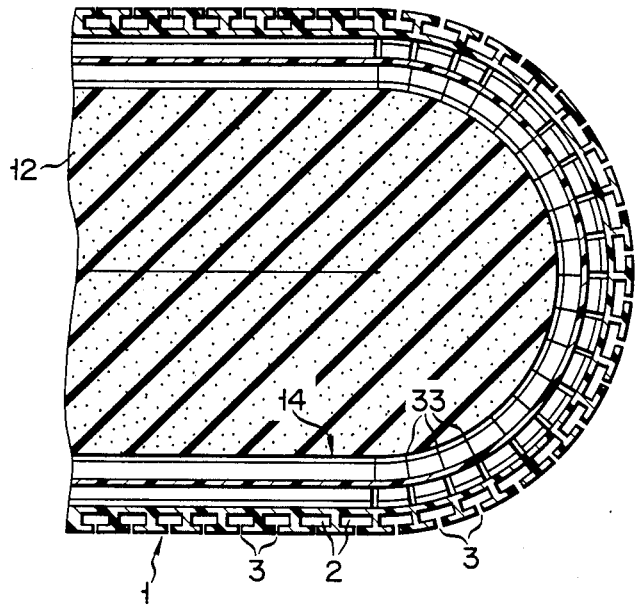
Figure 25:
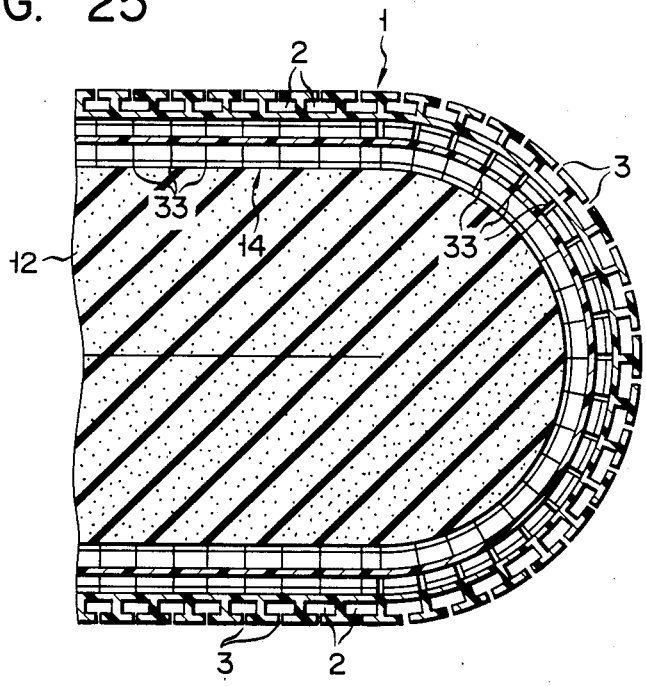
Figure 26:
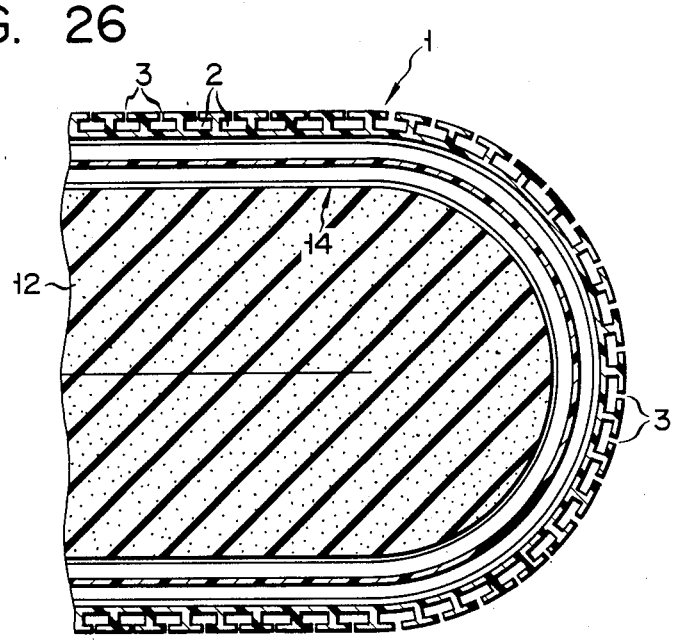
Figure 27:
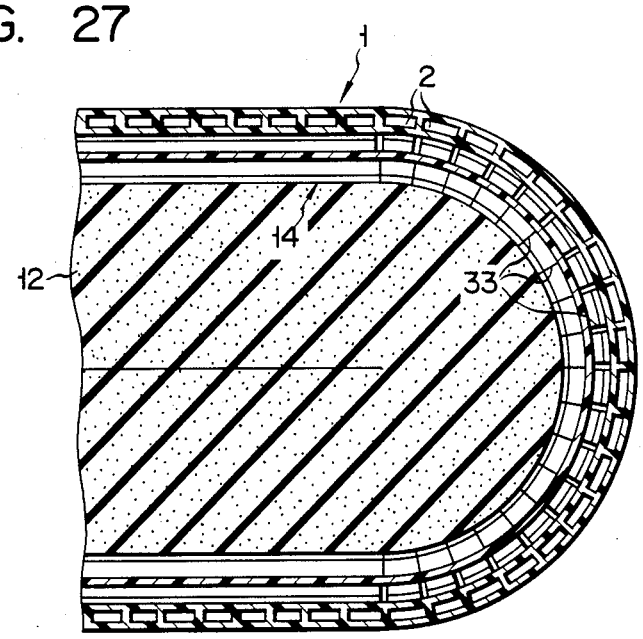
Figure 28:
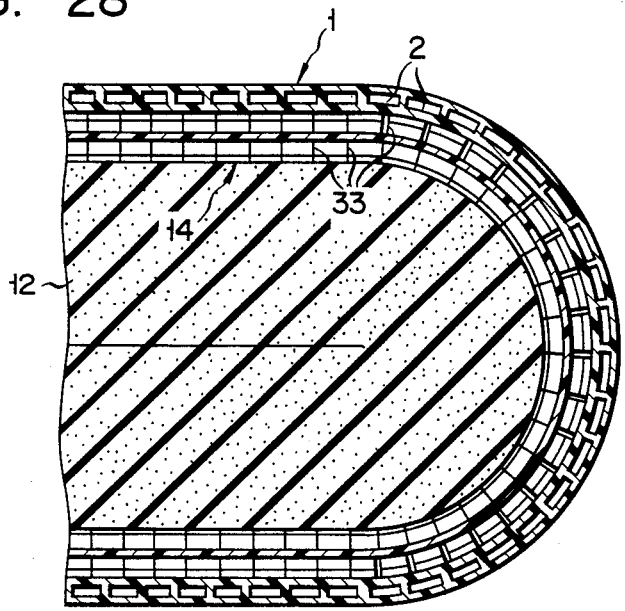
Figure 29:
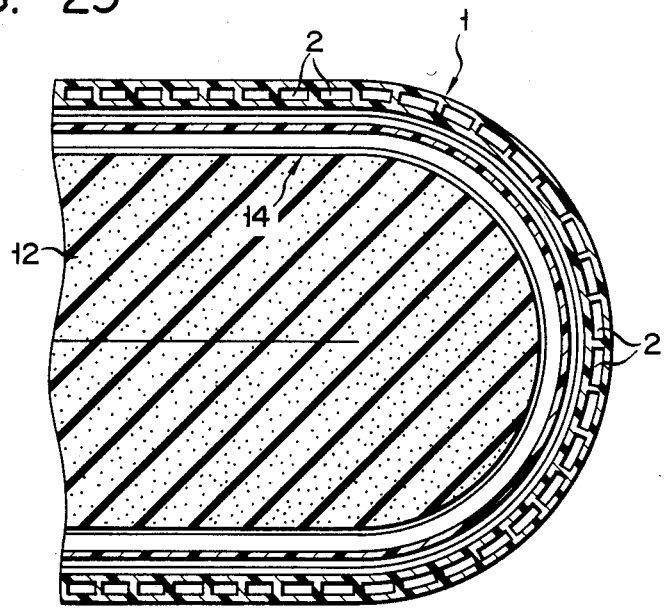

The structure for enabling the base plate 1 and the guide rails 14 to be folded over is not limited to the arrangegment described in connection with the above embodiment. Referring now to FIGS. 20 to 29, several modifications of such an arrangement will be described. Referring to FIG. 20, the predetermined folding portion of the base plate 1 is formed by coupling a plurality of belt-shaped plate members 120 by means of hinges 121. Referring to FIG. 21, the predetermined folding portion of the base plate 1 consists of a corrugated coupling member 122 made of an elastic material such as synthetic resin. Each end of the coupling member 122 is fixed to the end portion of each corresponding division of the base plate 1 by means of a fitting piece 123. Referring to FIG. 22, the slits 33 are arranged at regular intervals throughout the length of the guide rail 14. Referring to FIG. 23, the guide rail 14 is formed of a flexible material such as polypropylene or rubber, and can be folded without the slits 33. In the modification shown in FIG. 24, the slits 3 are arranged at regular intervals throughout the length of the base plate 1. FIG. 25 shows a combination of the guide rail 14 of FIG. 22 and the base plate 1 of FIG. 24, while FIG. 26 shows a combination of the base plate 1 of FIG. 24 and the guide rail 14 of FIG. 23. FIGS. 27 to 29 show modifications in which the base plate 1 is formed of a flexible material such as polypropylene or rubber, and can be folded without the slits 3. More specifically, FIG. 27 shows a combination of the base plate 1 with this arrangement and the guide rail 14 of FIG. 19; FIG. 28 shows a combination of the base plate 1 and the guide rail 14 of FIG. 22; and FIG. 29 shows a combination of the base plate 1 and the guide rail 14 of FIG. 23.

Figure 30:
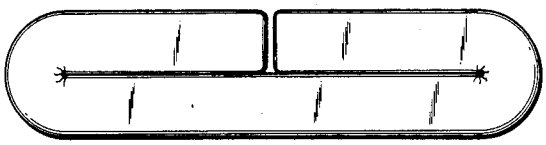
FIGS. 30 and 31 show different ways the massage apparatus is folded.
Figure 31:
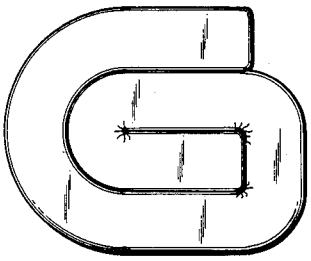

The above description is premised on an assumption that the massage apparatus is folded in two. Alternatively, however, the whole massage apparatus may be folded in the manner shown in FIGS. 30 or 31 by providing each of the base plate 1 and the guide rail 14 with two or more predetermined fold portions or by making the base plate 1 and the guide rail 14 foldable at any position in the aforementioned manner.

Figure 32:
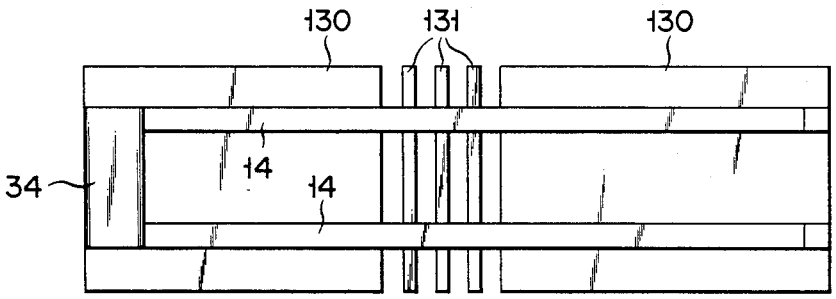
FIG. 32 is a plan view showing a modification of a base.
Figure 33:
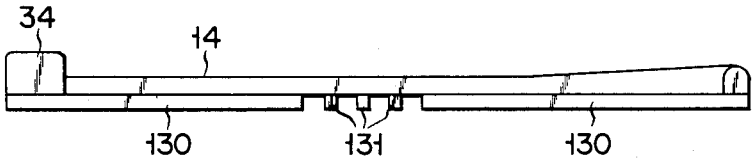
FIG. 33 is a side view of the base shown in FIG. 32.
Figure 34:
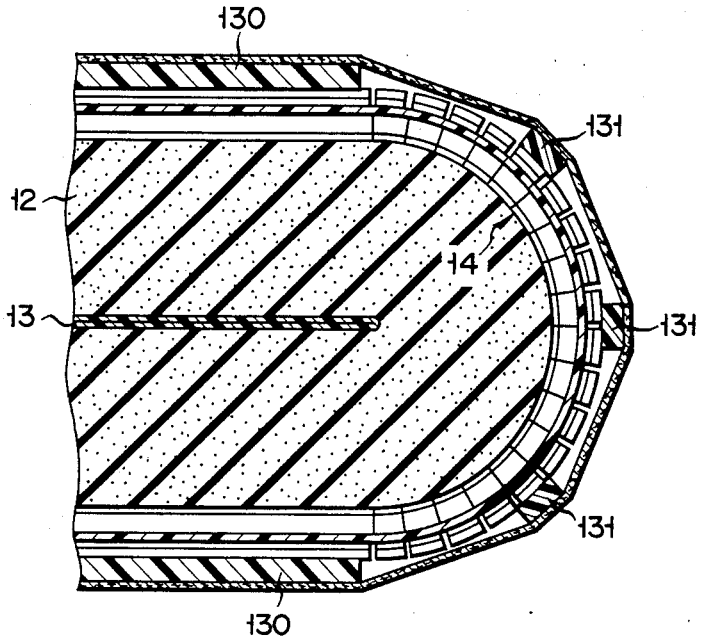
FIGS. 34 and 35 are sectional views showing different folding portions of the massage apparatus using the base of FIG. 32.
Figure 35:
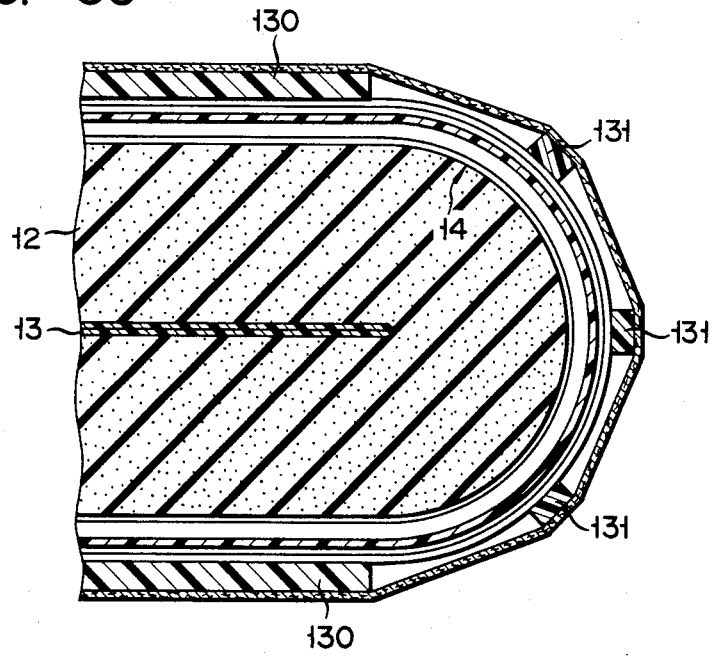
Figure 36:
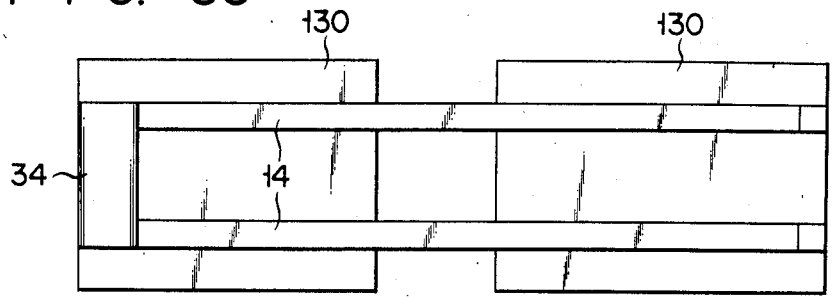
FIGS. 36 to 40 are plan views showing further modifications of the base.
Figure 37:
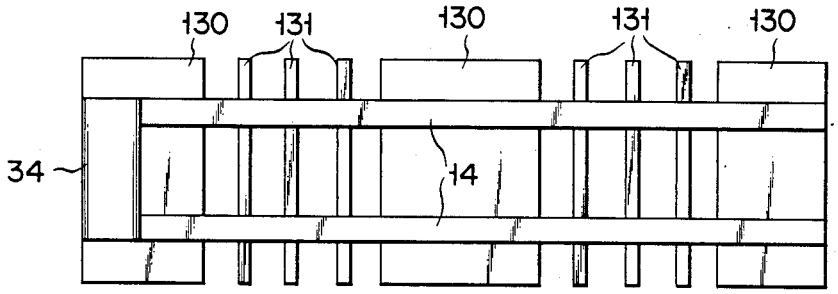
Figure 38:
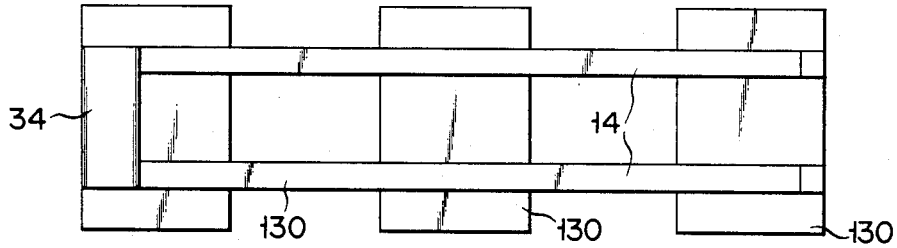
Figure 39:
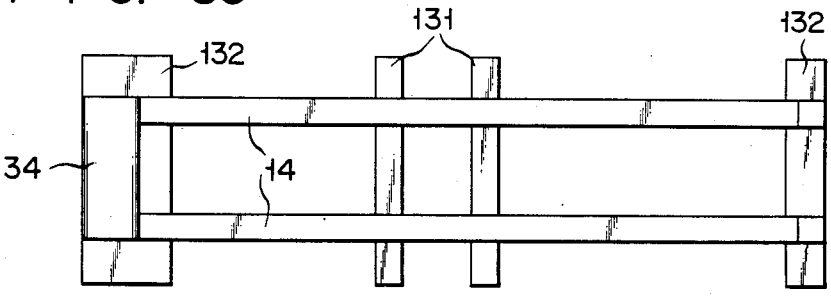

Referring now to FIGS. 32 to 41, there are shown several modifications to replace the base plate 1. Referring to FIGS. 32 and 33, a base to be used in place of the base plate 1 includes two flexible or rigid plates 130 arranged so as to support the whole length of each guide rail 14 except the central portion thereof, and a plurality of auxiliary crosspieces 131 arranged at regular intervals along the guide rails 14 between the plates 130. In this case, the massage apparatus may be folded in the manner shown in FIGS. 34 or 35, for example. FIG. 36 shows a modification in which the base is formed of the two plates 130 only, while FIG. 37 shows an example in which the base includes three plates 130 and the auxiliary cross-piece 131 arranged between the plates 130. The modification shown in FIG. 38 may be obtained by removing the auxiliary crosspieces 131 from the base of FIG. 37. FIG. 39 shows a base which is formed of two plates 132 at both ends of each guide rail 14 and two auxiliary crosspieces 131 arranged between the plates 132. With the use of the bases shown in FIGS. 37 to 39, the base can be folded at a plurality of positions.

Figure 40:
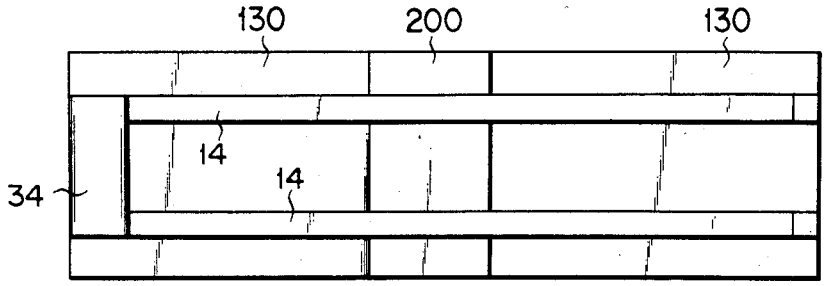
Figure 41:
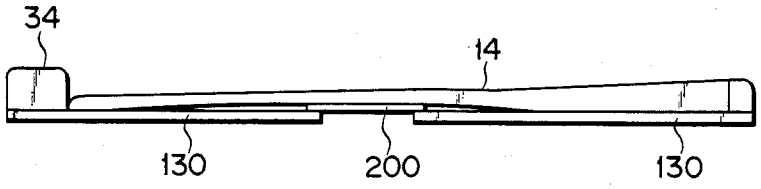
FIG. 41 is a side view of the base shown in FIG. 40.

FIGS. 40 and 41 show a base which comprises two rigid plates 130 and a flexible plate 200 disposed between the plates 130, the flexible plate 200 made of polypropylene, for example.

It is to be noted that the base may be provided as required, and is not an essential member.

Figure 42:
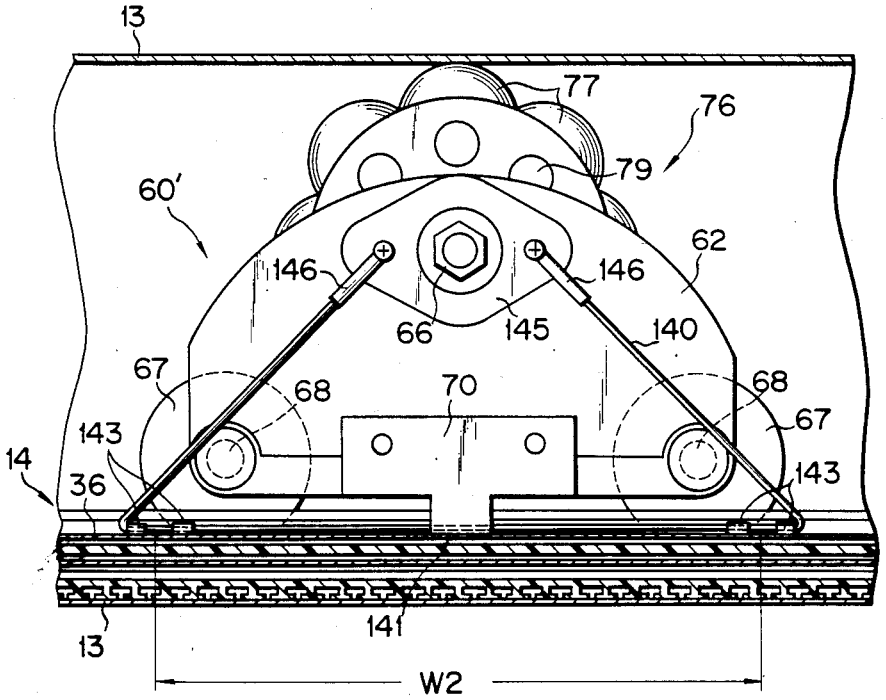
FIG. 42 is a front view showing a first modification of a carrier.
Figure 43:
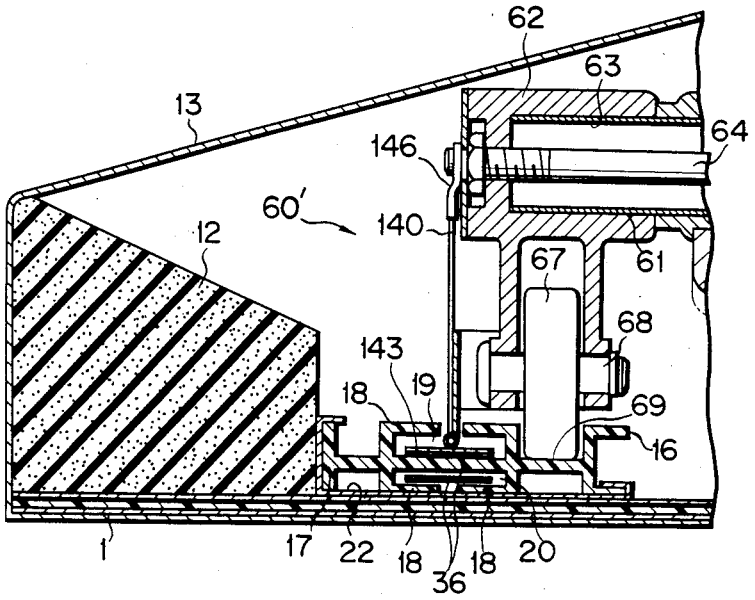
FIG. 43 is a sectional view of the carrier shown in FIG. 42.
Figure 44:
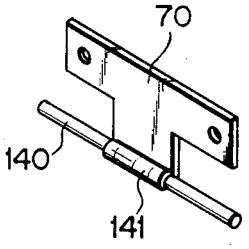
FIG. 44 is a perspective view of a coupling member used in the carrier of FIG. 42.
Figure 45:
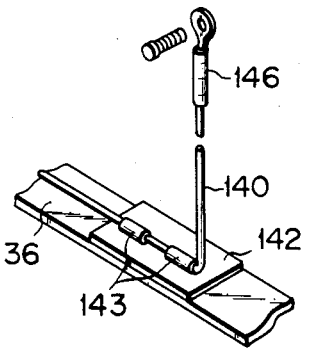
FIG. 45 is a perspective view showing the junction of a wire and a belt used in the carrier of FIG. 42.

Referring now to FIGS. 42 to 46, there is shown a first modification of the carriers 60. With a carrier 60' according to the first modification, the support leg 62 and the traveling belt 36 are not coupled directly by the coupler 70, and a wire 140 is used in aid of the coupler 70. As shown in FIG. 44, the wire 140 is slidably passed through a pipe portion 141 which is formed by bending the lower end portion of the coupler 70. Each end side of the wire 140 passed through the pipe portion 141 of the coupler 70 extends through the upper passage 19 of the guide rail 14, passes through a pair of pipes 143 fixed to the traveling belt 36 by means of a mounting plate 142, as shown in FIG. 45, and is then bent upward. Both ends of the wire 140 are attached to a mounting plate 145 on the support leg 62 with the aid of metal fittings 146 and a screw. Thus, the wire 140 forms a triangle with its base extending along the guide rail 14, as shown in FIG. 42.

Figure 46:
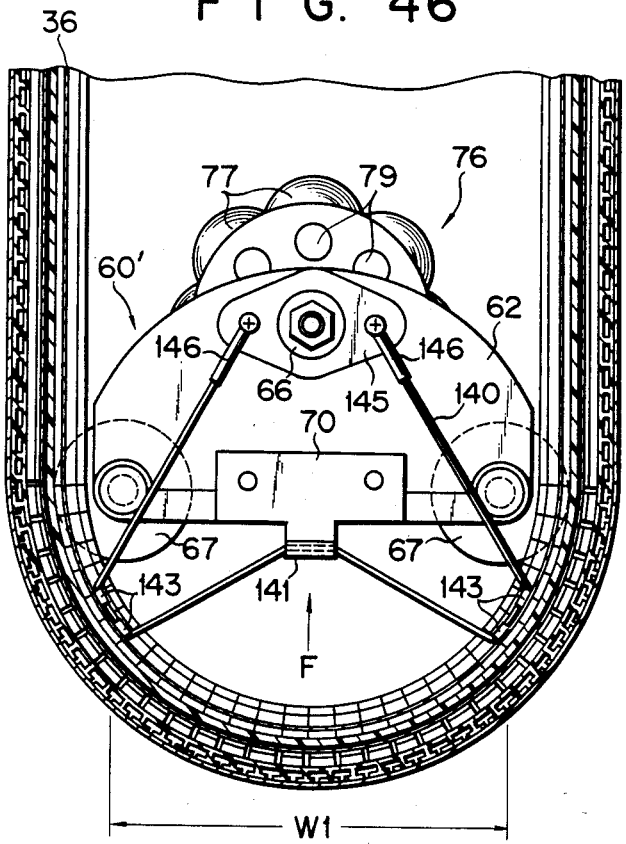
FIG. 46 is a sectional view of a fold portion of the massage apparatus folded at the location of the carrier of FIG. 42.

In the carrier 60' of the first modification, the wheels 67 are attached to the support leg 62 so as to project outward from the support leg 62, as shown in FIG. 42. With this arrangement, the massage apparatus can easily be folded even at the position where the carrier 60' is located. If the massage apparatus is folded at the location of the carrier 60', the base of the substantially triangular wire 140 is bent as shown in FIG. 46. As the wire 140 is bent in this manner, the carrier 60' is moved in the direction of arrow F in FIG. 46, so that the massage apparatus can easily be folded without being substantially hindered by the carrier 60'. If the distance between the pair of pipes 143 before the folding of the massage apparatus is w2, as shown in FIG. 42, the distance w1 between the pipes 143 after the folding is shorter than the distance w2 by a length for the flexure of the base of the wire 140. With the carrier 60' constructed in this manner, therefore, the massage apparatus can be folded with ease, and the fold portion can be made compact.

Referring now to FIGS. 47 to 50, there is shown a second modification of the carrier 60. In a carrier 60'' according to the second modification, the support leg 62 is provided with a pair of first links 150 which are rockably mounted at the upper end portion thereof on each hollow shaft 61. The lower end portions of the first links 150 spread away from each other, and are rotatably fitted with the wheels 67 by means of the support shafts 68. One end of each of a pair of second links 151 is rockably coupled to the support shaft 68 of each corresponding wheel 67. The other ends of the second links 151 are rockably coupled to a first coupler 152 by means of a pin 153. The first coupler 152 is fixed to the traveling belt 36 guided through the upper passage 19 of the guide rail 14. Second couplers 154 are attached to the support shafts 68 of their corresponding wheels 67. The support shafts 68 of the wheels 67 are passed through guide holes 155 in their corresponding second couplers 154, and the second couplers 154 are fixed to the traveling belt 36 in the guide rail 14 in the same manner as the first coupler 152.

Figure 50:
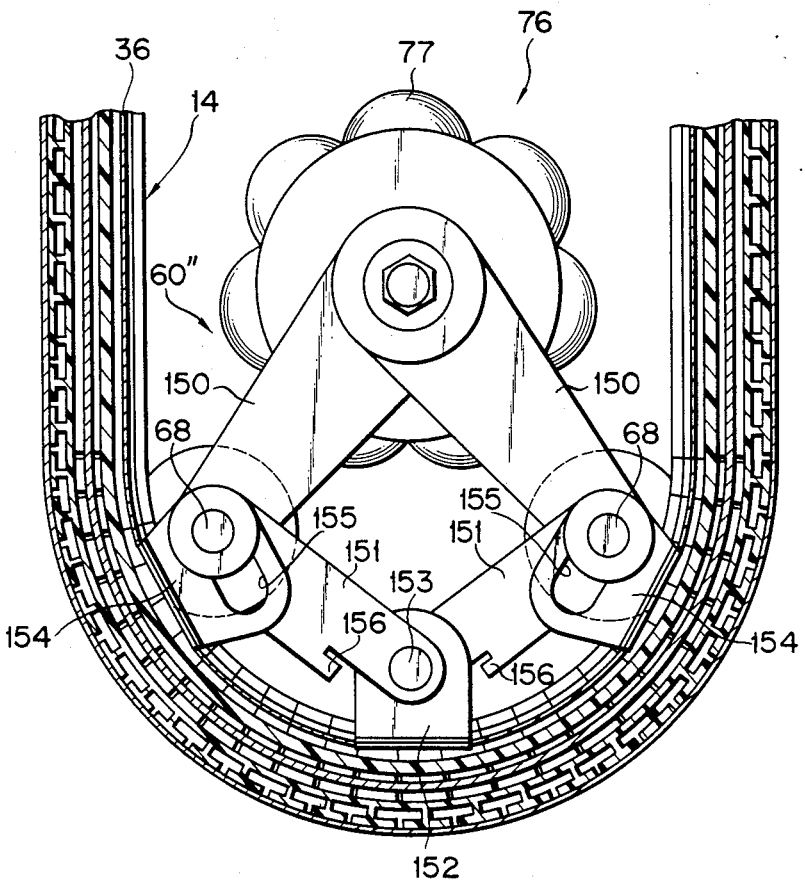
FIG. 50 is a sectional view of a folding portion of the massage apparatus folded at the location of the carrier of FIG. 47.

Thus, as seen from FIG. 50, the carrier 60'' of the second modification can provide the same function and effect as those of the carrier 60' of the first modification.

Figure 47:
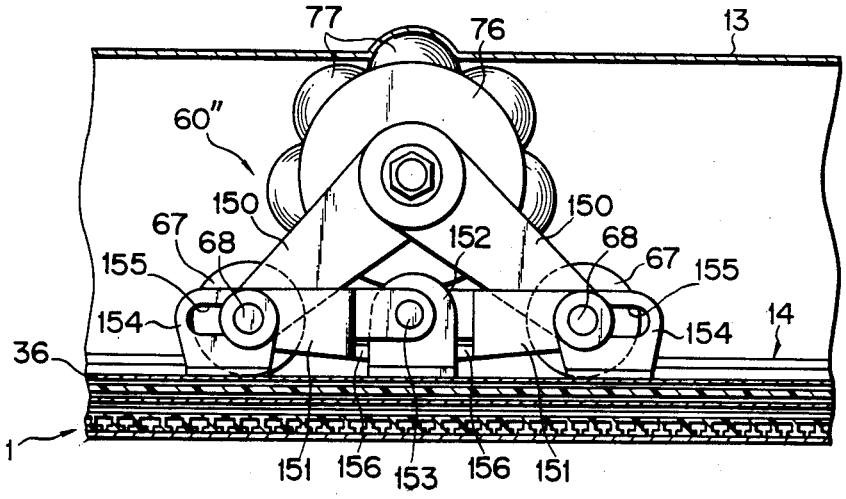
FIG. 47 is a side view showing a second modification of the carrier.
Figure 48:
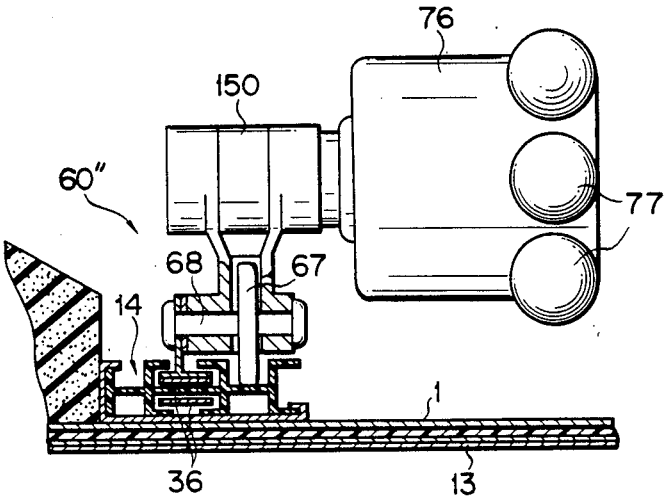
FIG. 48 is a front view partially in section showing the carrier of FIG. 47.
Figure 49:
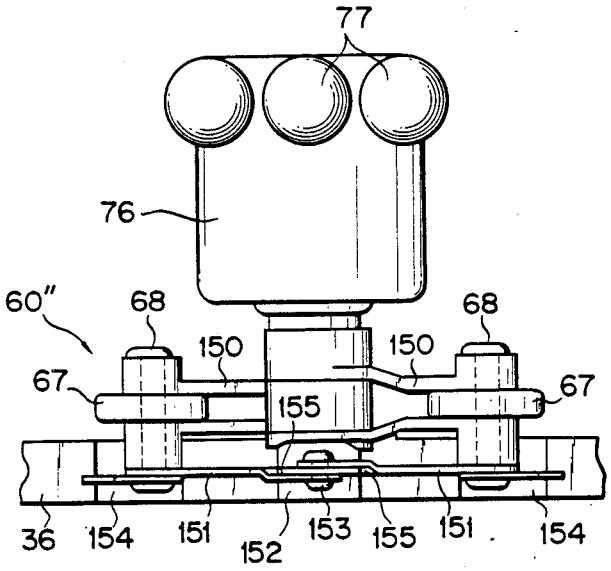
FIG. 49 is a cut-away plan view showing the carrier of FIG. 47.

In FIG. 47, stoppers 156 are attached to the second links 151. The stoppers 156 are adapted to abut against the side faces of the first coupler 152, thereby preventing the second links 151 from rocking further downward.

In the above description of the modifications like reference numerals are used to designate like members used in the foregoing embodiment.

What is claimed is:

1. A massage apparatus for massaging the body of a user, comprising:

an elongate flexible body for accommodating the body of a user when lying down, said body being adapted to be folded along at least one line transverse to the long direction of said body;

at least one pair of guide rails located within the flexible body and extending parallel to each other in said long direction;

folding means for enabling said pair of guide rails to be folded over together with the flexible body along said at least one line;

at least one carrier arranged for movement along the pair of guide rails in said long direction, said carrier including:

(a) a roller shaft located between the pair of guide rails and extending perpendicular to the guide rollers;

(b) at least one massage roller attached to the roller shaft for rotation therewith; and (c) a wheel unit provided at each end of the roller shaft, said wheel unit including a support leg which is attached to the roller shaft at one end and which extends toward a corresponding guide rail at the other end, and a pair of wheels mounted for rotation at said other end of the support leg so that said wheels can roll along the corresponding guide rail, said wheels being spaced apart from each other by a predetermined distance in the long direction of the guide rail; and driving means for reciprocating the carrier along the guide rails, said driving means incuding:

(a) a driving source located within the flexible body in the vicinity of one end of the guide rails;

(b) each guide rail forming a guide path extending in the long direction of the guide rail;

(c) a power-transmitting belt arrange for travel in each said guide path and extending in the long direction of the path, said power-transmitting belt being coupled to said driving source for reciprocating movement; and (d) coupling means for coupling the power-transmitting belts and said carrier to one another, and for enabling said carrier to travel reciprocatingly along the guide rails in response to the movement of the power-transmitting belts by said driving source.

2. An apparatus according to claim 1, wherein said guide rails are two in number.

3. An apparatus according to claim 1, wherein each said guide rail is formed of a synthetic resin capable of elastic deformation, and has in the middle portion thereof a number of slits arranged at regular intervals along said guide rail, whereby the guide rail can be folded.

4. An apparatus according to claim 3, wherein the slits are arranged at regular intervals throughout the length of said guide rail.

5. An apparatus according to claim 1, wherein each said guide rail is integrally formed from a flexible material, and can be folded at any portion thereof.

6. An apparatus according to claim 1, further comprising a base plate underlying said guide rails and capable of being folded together therewith.

7. An apparatus according to claim 6, wherein the base plate is formed of a synthetic resin capable of elastic deformation, and has in the middle portion thereof a number of slits arranged at regular intervals along the longitudinal direction of the base plate, whereby the base plate can be folded.

8. An apparatus according to claim 7, wherein the slits are arranged at regular intervals throughout the length of the base plate.

9. An apparatus according to claim 6, wherein the base plate is integrally formed from a flexible material, and can be folded at any portion thereof.

10. An apparatus according to claim 6, wherein one end portion of each said guide rail is fixed to the base plate, and the other end portion of said guide rail is slidably held by at least one support member on the base plate.

11. An apparatus according to claim 6, wherein the base plate comprises a pair of first plates arranged so as to support the whole length of said guide rails except the central portion thereof, and a second plate disposed between the first plates, the second plate being formed from a flexible material.

12. An apparatus according to claim 6, wherein the driving source of said driving means is disposed on the base plate, and further comprising a reinforcement plate underlying that portion of the base plate on which the driving source of said driving means is disposed.

13. An apparatus according to claim 12, wherein the reinforcement plate is formed from a flexible material.

14. An apparatus according to claim 12, wherein the reinforcement plate is formed from a rigid material.

15. An apparatus according to claim 12, wherein said driving means includes a control unit for reciprocating the power-transmitting belt the control unit comprising a rotating disk adapted to be rotated together with the first and second drums by the electric motor and having a first spiral guide groove formed on one side face thereof and a second spiral guide groove on the other side face, the first and second guide grooves having first and second step portions shallower than the remaining groove portions, respectively, at different radial distances from the center of rotation of the rotating disk; first and second control pins fitted in those portions of the first and second guide grooves, respectively between the first and second step portions with respect to the radial direction of the rotating disk and movable in the radial direction, guided by their corresponding first and second guide grooves as the rotating disk rotates; and first and second changeover switches adapted to be actuated to reverse the rotating direction of the electric motor by the first and second control pins when the first and second control pins are moved to the positions of their corresponding first and second step portions.

16. An apparatus according to claim: 1, wherein the driving source of said driving means includes a reversible electric motor first and second drums at said one end of the guide rails, said drums being adapted to be rotated in relatively opposite directions by the electric motor, and a direction-changing pulley at the other end of each of the guide rails, wherein each power-transmitting belt extends along the path in an associated guide rail with one end of said belt wound around said first drum, changes its course at said direction-changing pulley disposed at said opposite end of said guide rail to extend through the path in said guide rail, and is wound at the opposite end of said belt around the second drum.

17. An apparatus according to claim 1, wherein the power transmitting belt is made of stainless steel.

18. A massage apparatus according to claim 1, wherein each said guide rail includes a partitioning wall for dividing the path into a first path for guiding a first portion of said belt extending from the first drum to the direction-changing pulley, and a second path for guiding a second portion of said belt extending from the pulley to the second drum.

19. A massage apparatus according to claim 1, comprising escape means for moving the carrier from a to-be-folded portion of the guide rails along the guide rails, said escape means being adapted to move the carrier away from the to-be-folded portion if said pair of wheels are located at the to-be-folded portion when said pair of guide rails and said flexible body are folded.

20. An apparatus according to claim 19, wherein the support leg has a pair of first links one end of which is rockably attached to the shaft member and the other end of which is each fitted with a wheel by means of a support shaft, a pair of second links one end of which is rockably attached to the other end of the corresponding first links and the other end of which is rockably coupled to each other, a first coupler for coupling the other ends of the second links to the elongate member, and second couplers for coupling the other ends of the first links to the elongate member, each the second couplers having a guide hole in which the support shaft of each corresponding wheel is loosely fitted.

21. A massage apparatus according to claim 19, wherein said coupling means includes a bendable wire for connecting each wheel unit to the corresponding power-transmitting belt; and said escape means includes a first coupling member for connecting the ends of the wire to the wheel unit, the wire being bent into a triangular shape, a pair of second coupling members fixed to the power-transmitting belt and spaced from each other in the long direction of said belt, said second coupling member including a pipe portion extending along the belt for slidably receiving both ends of the base of the triangular shaped wire, and a third coupling member fixed to the wheel unit, the third coupling member including a pipe portion for slidably receiving the central portion of the triangular shaped wire.

* * * * *